US005128591A

United States Patent [19]

Bocan

[11] Patent Number: 5,128,591

[45] Date of Patent: Jul. 7, 1992

[54] STROBE ALARM CIRCUIT

[75] Inventor: Kenneth J. Bocan, Ocean, N.J.

[73] Assignee: Wheelock Inc., Long Branch, N.J.

[21] Appl. No.: 728,123

[22] Filed: Jul. 10, 1991

[51] Int. Cl.[5] ..... H05B 41/32

[52] U.S. Cl. ..... 315/241 S; 315/200 A; 340/331

[58] Field of Search ..... 315/200 R, 200 A, 241 R, 315/241 P, 241 S; 354/145.1, 413, 416; 340/331

[56] References Cited

U.S. PATENT DOCUMENTS

| | | | |
|---|---|---|---|
| 3,921,034 | 11/1975 | Nakamura | 315/241 P |
| 3,946,271 | 3/1976 | Stepp et al. | 315/241 S |
| 4,013,921 | 3/1977 | Corthell | 315/241 R |
| 4,065,700 | 12/1977 | Liebman | 315/241 P |
| 4,101,880 | 7/1978 | Haus | 340/326 |
| 4,495,447 | 1/1985 | Shigemi | 315/241 P |
| 4,613,797 | 9/1986 | Eggers et al. | 315/241 R |
| 4,628,229 | 12/1986 | Inoue | 315/241 P |
| 4,742,328 | 5/1988 | Arai et al. | 340/326 |
| 4,775,821 | 10/1988 | Sikora | 315/219 |
| 4,779,027 | 10/1988 | Sikora | 315/127 |
| 4,952,906 | 8/1990 | Buyak et al. | 340/331 |
| 4,967,177 | 10/1990 | Nguyen | 340/326 |

*Primary Examiner*—Eugene R. LaRoche
*Assistant Examiner*—Michael B. Shingleton
*Attorney, Agent, or Firm*—Brumbaugh, Graves, Donohue & Raymond

[57] ABSTRACT

A strobe light circuit for flashing a flashtube at a desired frequency includes a transformer the primary of which is repetitively connected and disconnected across a D.C. power source by a switch so that energy stored in the primary winding during closed periods of the switch is transferred to the secondary winding of the transformer, with a step-up in voltage, during open periods of the switch, and through a diode to an energy-storing capacitor connected in parallel with the flashtube. The closed period of each switch cycle is initiated at regular intervals by a timing signal and the open period is initiated in response to the attainment of a predetermined voltage across a capacitor connected across the power source indicating that sufficient energy is being stored in the primary winding during each cycle such that the energy transferred to the energy-storing capacitor during the open period of all cycles occurring during one flash period will be sufficient to enable the flashtube to produce a flash when triggered. A flash unit associated with the flashtube includes a trigger circuit that responds to two closely following trigger pulses to produce a double flash during each flash period. The flash rate is constant over a range of input voltages and the light intensity of each flash is independent of variations in capacitance of the energy-storing capacitor.

13 Claims, 3 Drawing Sheets

STROBE ALARM CIRCUIT

BACKGROUND OF THE INVENTION

This invention relates to circuits for electronic strobe lights such as are used to provide visual warning of potential hazards or to draw attention to an event or activity. Such devices are used in electronic fire alarm systems and are frequently associated with audible warning devices such as horns, and provide an additional means for alerting those persons who may be in danger. Strobe alarm circuits include a flashtube and a trigger circuit for initiating firing of the flashtube, with energy for the flash typically supplied from a capacitor connected in shunt with the flashtube. In some known systems, the flash occurs when the voltage across the flash unit (i.e., the flashtube and associated trigger circuit) exceeds the threshold value required to actuate the trigger circuit, and in others the flash is triggered by a timing circuit. After the flashtube is triggered it becomes conductive and rapidly drains the stored energy from the shunt capacitor until the voltage across the flashtube has decreased to a value at which the flashtube extinguishes and becomes non-conductive. In a more specific sense, the present invention relates to apparatus for charging the energy-storing capacitor.

Typical of prior art strobe light devices is that described in U.S. Pat. No. 4,952,906 entitled "Strobe Alarm Circuit" for flashing a flash unit at a desired frequency. The capacitor connected in shunt with the flash unit is charged from an inductor which is repetitively connected and disconnected across a D.C. power line by a switch so that energy is stored in the inductor during the period when the switch is closed and transferred to the capacitor when the switch is open. During the open period of the switch the parallel combination of the flash unit and the capacitor is connected across the inductor in such a manner that current will not flow from the power line through the flash unit or the capacitor. The switch is repetitively cycled between open and closed, the open period being initiated in response to the current flowing through a resistor connected in series with the inductor attaining a particular value and the closed period being initiated in response to a periodic timing signal. When the switch has been cycled the number of times required to transfer sufficient energy to the capacitor to attain the threshold firing voltage of the flash unit, the capacitor discharges its stored energy through the flashtube.

This circuit has the disadvantage that power is needlessly wasted in the resistor connected in series with the inductor for determining when the current flowing though the inductor has attained a particular value.

Although the strobe flashing rate of the circuit of the '906 patent is said to be determined independently of the supply voltage, because firing of the flashtube depends on the voltage of the storage capacitor reaching a firing threshold voltage, both the flash rate and flash intensity will vary with changes in capacitance of the storage capacitor. As the electrolytic capacitor normally used as the storage capacitor has a wide capacitance tolerance, the flash rate and intensity of the flash could vary greatly from unit to unit. Additionally, the light output and flash rate will be directly affected by changes in capacitance due to aging and variations in operating temperatures.

In order to overcome the described disadvantages and shortcomings of known prior art circuits, the present invention has as an object to provide an improved strobe light circuit the flash rate of which is not dependent o the supply voltage.

Another object of the invention is to provide a strobe light circuit which produces a substantially constant light output independent of the capacitance tolerance of the energy storage capacitor.

A further object is to provide a strobe light circuit which has a higher operating efficiency than prior art circuits by avoiding the power loss in a resistor used in the prior circuit to sense charging current.

SUMMARY OF THE INVENTION

Briefly, the strobe light circuit according to the invention flashes a flash unit twice in close succession at a desired frequency. The primary winding of a transformer is repetitively connected and disconnected across a D.C. power line by a switch such that energy is stored in the primary during the period when the switch is closed and is discharged to induce a stepped-up voltage in the secondary winding of the transformer when the switch is opened. The flash unit and a capacitor are connected in parallel with each other and with the secondary winding of the transformer so that each time the switch is opened an incremental amount of energy is transferred to the capacitor. The switch is repetitively cycled between open and closed, the closed period being initiated in response to a fixed frequency periodic timing signal and the open period being initiated in response to the transformer primary current attaining a particular value, which is determined by monitoring the voltage developed across a capacitor connected across the power source. The energy delivered to the storage capacitor during each cycle is independent of the input voltage and the switch is cycled at a rate sufficient that the energy transferred to the storage capacitor during a desired flash period, for example one second, charges the storage capacitor to a predetermined value which exceeds the threshold firing voltage of the flashtube. Two closely following flashes occurring at a constant rate are produced by applying to the trigger circuit pairs of closely following trigger pulses (e.g., separated by 0.2 second) separated from each other by the desired flash rate period (e.g., 1.0 second for a flash rate of 60 per minute).

Other objects, features and advantages of the invention will become apparent, and its construction and operation better understood, from the following detailed description of the currently preferred embodiment, read in conjunction with the accompanying drawings.

DETAILED DESCRIPTION OF THE PREFERRED EMBODIMENT

Figure 1:
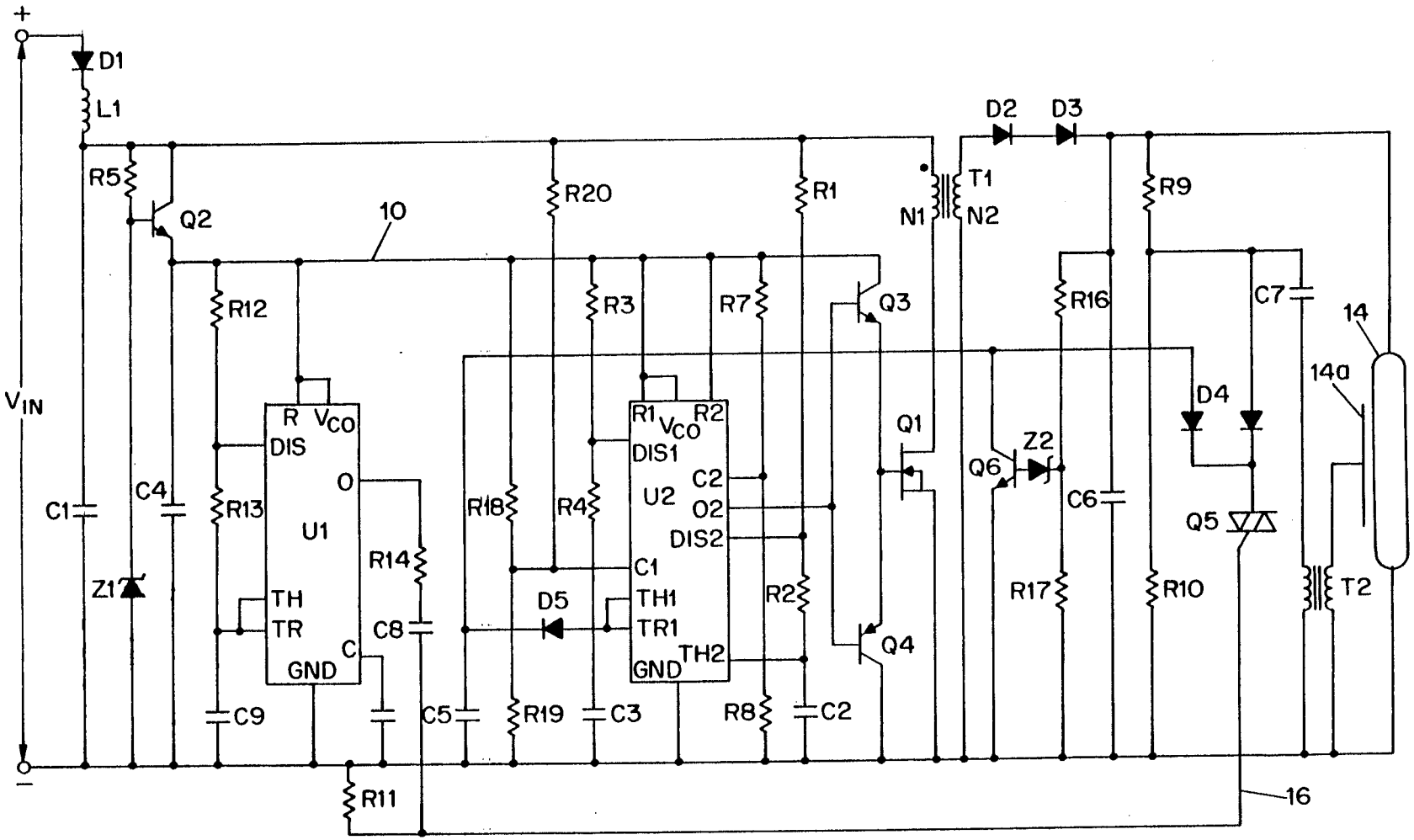
FIG. 1 is a circuit diagram showing in detail a preferred embodiment of the strobe circuit according to the invention.

Referring to FIG. 1, a first embodiment of the invention is shown as being connected across a D.C. voltage source, not shown, which supplies a voltage $V_{in}$, which may have a wide range of values, from 12 volts to 90 volts, for example. The voltage is applied through a diode D1, which typically has a voltage drop of 0.7 volt, to an input filter which includes a series inductor L1 and a shunt capacitor C1. Connected in parallel with shunt capacitor C1 is a series combination of resistors R1 and R2 and a capacitor C2, and a series combination of the primary winding N1 of a transformer T1 and a switch Q1, which may be a MOSFET transistor. Switch Q1 is repetitively opened and closed and timed by cooperation of the voltage developed across capacitor C2, which provides an indication of the magnitude of the current flowing through N1 when switch Q1 is closed, and a timer U2. Timer U2 may be a KS556 integrated circuit timer consisting essentially of two Samsung Semiconductor KS555 general purpose RC timers incorporated in the same package. The KS555 is a stable controller capable of producing accurate time delays or frequencies, which for stable operation as an oscillator, as here used, the free-running frequency and the duty cycle are both accurately controlled by two resistors R3 and R4 and a capacitor C3; the THRESHOLD and TRIGGER terminals of a first of the two timers are connected to the junction between capacitor C3 and resistor R4. Its DISCHARGE terminal is connected to the junction of resistors R3 and R4. The RESET and $V_{CO}$ terminals are connected to a line 10, on which a stable voltage is maintained by a voltage generator comprising the series combination of resistor R5 and Zener diode Z1, and the series combination of a switch Q2, which may be a transistor, and a capacitor C4, both connected in parallel with capacitor C1, with the base electrode of the transistor connected to the junction of resistor R5 and Zener diode Z1 and with its emitter electrode connected to line 10.

The RESET terminal of the second timer is connected to line 10, its DISCHARGE terminal is connected to the junction of resistors R1 and R2, its control voltage terminal is connected to a voltage divider comprising resistors R7 and R8 connected in series from line 10 to ground, and its THRESHOLD terminal is connected to the junction of resistor R2 and the current-monitoring capacitor C2. The OUTPUT terminal of the second timer is connected to the base electrode of each of a pair of transistors Q3 and Q4 having their collector electrodes connected to line 10 and ground, respectively, and their emitter electrodes connected together and to the base electrode of MOSFET transistor Q1.

Figure 2:
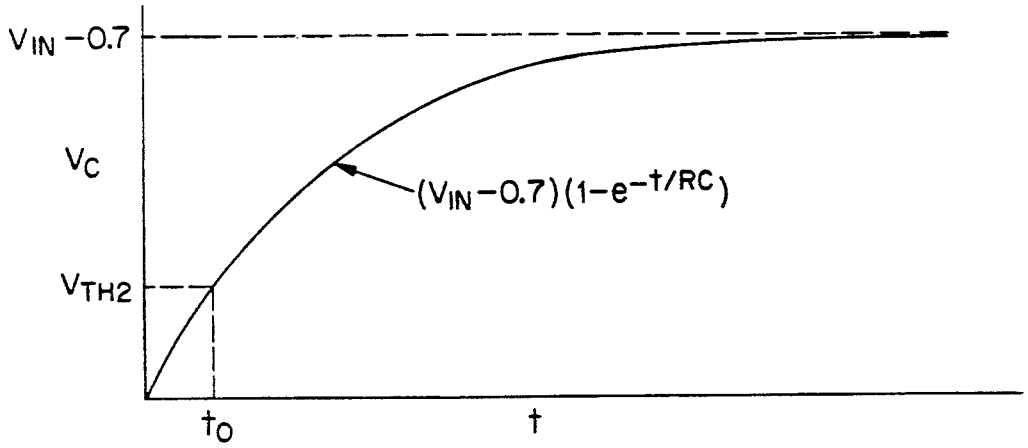
FIGS. 2 and 3 ar curves showing the build up of voltage across a current-sensing capacitor and the buildup of current flowing in the primary winding of the isolating transformer, respectively, both as a function of time.
Figure 3:
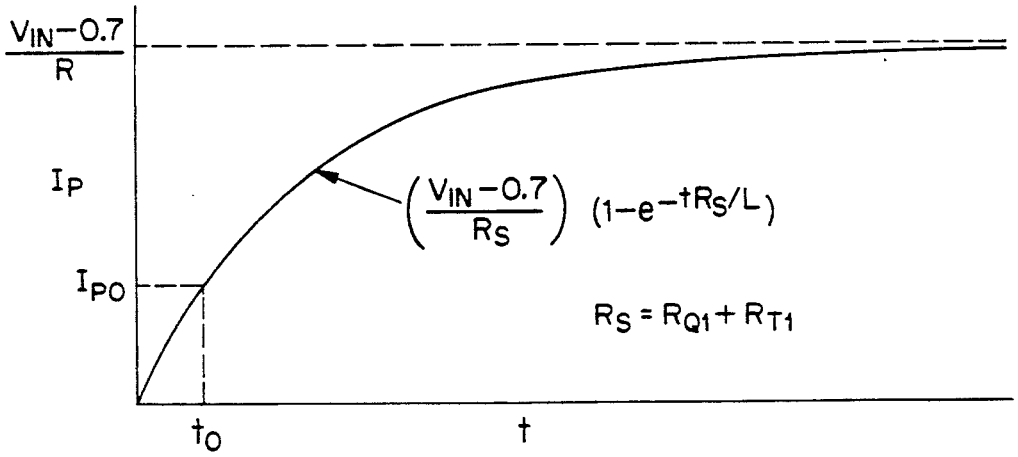

When switch Q1 is closed the current flow, $1_p$, through primary winding N1 upon application thereacross of the voltage $(V_{in}-0.7)$ is $[(V_{in}-0.7)/R_S](-1-e^{tR_S/L})$, as shown in FIG. 3, where $R_s$ is the combined resistance of the primary winding and the switch Q1 and L is the inductance of the transformer primary, building up from the zero value existing when switch Q1 closed to initiate a charging cycle. At the same time, the voltage $(V_{in}-0.7)$ applied across the series combination of resistors R1, R2 and capacitor C2 causes the voltage across C2 to build up exponentially, as shown in FIG. 2, according to the expression $(V_{in}-0.7)(1-e_{-t/RC})$, where R is the combined resistance of resistors R1 and R2, C is the capacitance of C2, and t is elapsed time in seconds after Q1 is switched "ON". Switch Q1 remains closed until the voltage across capacitor C2 reaches the threshold voltage $V_{TH2}$ of the second timer, shown in FIG. 2 as occurring at time $t_o$, at which time the second timer of U2 produces at its terminal O2 and applies to the base electrodes of transistors Q3 and Q4 an output pulse which renders switch Q1 non-conductive. The values of resistors R1 and R2, capacitor C2 and $V_{TH2}$ are so related to the values of the inductance L of the primary winding N1 and the resistance $R_s$ that when the voltage on capacitor C2 equals $V_{TH2}$, the current flowing through the primary N1 will have a value $I_{po}$, which, as seen in FIG. 3, is much lower than could be obtained if switch Q1 remained "ON" for a period longer than $t_o$. When switch Q1 is turned "OFF" as described, capacitor C2 discharges and the energy stored in the primary winding N1 is transferred via the secondary winding N2, with a step-up in voltage, to a storage capacitor C6 connected in parallel with a flashtube 14.

Figure 4:
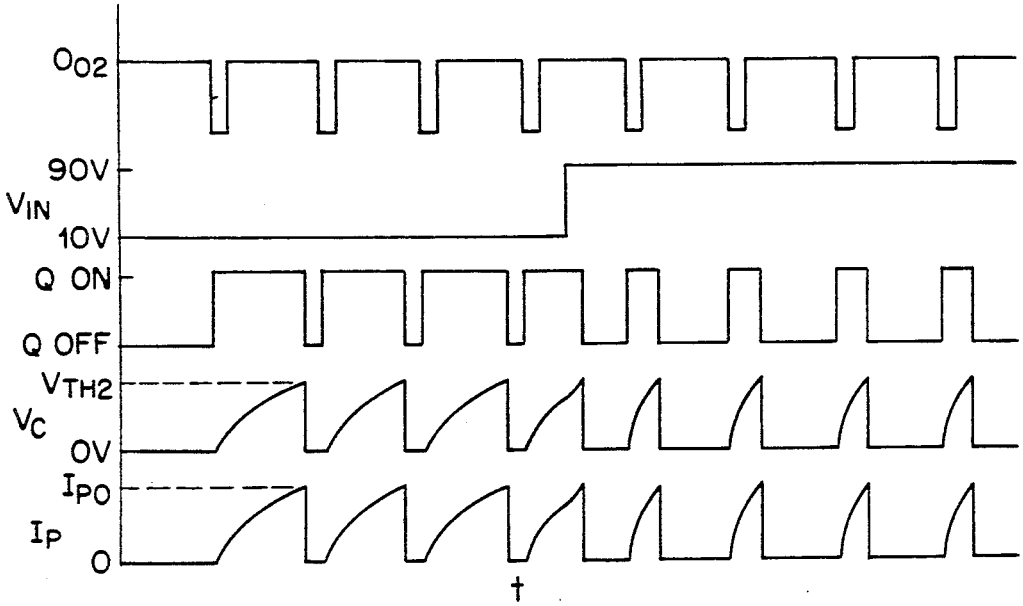
FIG. 4 is a series of waveforms which illustrate how the circuit produces constant power output independently of variations in voltage of the input source.

The amount of energy transferred to storage capacitor C6 upon each opening of switch Q1 is maintained constant, independent of wide variations in the value of $V_{in}$, say from 12 volts to 90 volts, by initiating each charging cycle at regular intervals by closing switch Q1 in response to a narrow negative square wave pulse having a frequency sufficiently high to supply increments of energy to the storage capacitor at a rate such that over the desired flash rate period of the flashtube, typically one second, the storage capacitor will attain a voltage sufficient to fire the flashtube twice. This signal, depicted by the top waveform of FIG. 4, is generated by the first timer of U2, and may have a frequency on the order of 20kHz. The leading edge of each pulse turns switch Q1 "ON" to start a charging cycle, the duration of which is determined by the time it takes for the input current to reach the value of $I_{po}$ to turn Q1 "OFF". As illustrated in the left-hand portion of FIG. 4, with a $V_{in}$ voltage of 12 volts, the buildup of the current through the primary N1 and the charge across capacitor C2, both being voltage dependent, is relatively slow and most, but not all, of the period between timing pulses is required for the voltage across capacitor C2 to reach the TH2 voltage to turn switch Q1 "OFF".

Should the value of $V_{in}$ be abruptly increased to 90 volts, for example, depicted in FIG. 4 as occurring during an "ON" period of switch Q1, the rate of current and charge buildup is significantly increased so that $V_{TH2}$ is reached early in each period of the timing signal, causing the switch Q1 to be "OFF" for longer periods than it is "ON". The energy transferred to the storage capacitor during each "OFF" period is $0.5\times L\times I_{po}^2$, and for a cycling frequency of $f_o$ the power delivered to the storage capacitor is $0.5\times f_o\times L\times I_{po}^2$, and is independent of the value of the input voltage within a designed range.

The cycling frequency $f_o$ of the first timer varies slightly over the designed operating voltage range of say, 12 volts to 90 volts; at an input voltage of 12 volts the cycling frequency may, for example, be 20kHz and at an input voltage of 90 volts the frequency may decrease to 18 kHz. The cycling frequency $f_o$ is automatically controlled by a voltage divider comprised of resistors 18 and !9 connected in series between line 10 and ground, which supplies a reference voltage to the CON- TROL pin of the first timer, and a resistor 20 connected between the positive terminal of the input voltage source and the CONTROL pin of the first timer. As the input voltage increases the additional current passing through resistor R20 causes the reference voltage provided by the voltage divider R18, R19 to increase, which when applied to the CONTROL pin results in a decrease in the output frequency of the timer. This decrease in frequency with increases of the input voltage is necessary to offset the effect of the propagation delay time between when the threshold voltage across the current sensing capacitor C2 reaches its predetermined level and the MOSFET transistor Q1 is switched off. For example, with an input voltage of 12 volts the maximum current allowed through the primary N1 of transformer T1 is $I_{po}$; as the input voltage is increased, $I_{po}$ increases slightly. The resistance values of resistors R18, R19 and R20 are so related to the parameters of the first timer that the cycling frequency $f_o$ will vary at a rate that is inversely proportional to the change in the square of $I_{po}$ so that the power delivered to the storage capacitor C6 ($0.5 \times f_o \times L \times I_{po}^2$) remains substantially constant throughout a wide range of input voltages.

By way of brief summary, when switch Q1 is opened, i.e., turned "OFF", the collapsing field of the primary N1 induces a voltage therein which is coupled with a step-up in voltage, and with the polarity shown, to the secondary winding N2, and its energy will flow to storage capacitor C6 causing current to flow through series-connected diodes D2 and D3. During the open period of each switch cycle, the primary winding N1 will in this manner discharge its energy to capacitor C6 until the voltage across the secondary N2 and that across capacitor C6 are equal. The repetitive opening and closing of switch Q1 will eventually charge the capacitor to the point where the voltage across it attains a value sufficient to flash a flashtube.

The storage capacitor C6 is connected in parallel with a voltage divider comprised of series-connected resistors R9 and R10. The reference voltages produced at the junction is supplied to the parallel combination of a capacitor C7 and the primary of a trigger transformer T2 and a TRIAC Q5. The secondary of the autotransformer is connected to the trigger band 14*a* of the flashtube 14 so that when the TRIAC is triggered (in a manner to be described) the charge on C7 will flow through the primary of the trigger transformer inducing a voltage in its secondary and causing the flashtube 14 to become conductive.

Figure 5:
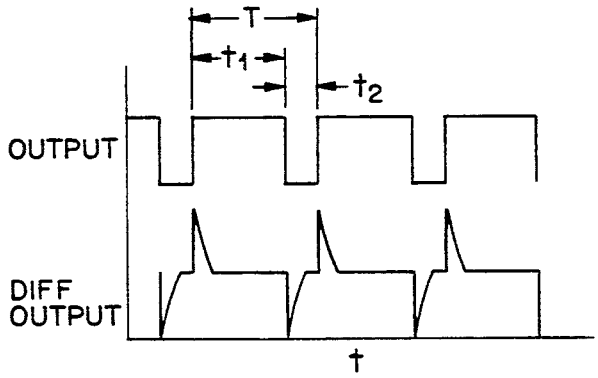
FIG. 5 are waveforms illustrating pulse signals for triggering the flash unit to produce a double flash.

It having been long recognized, as observed in U.S. Pat. No. 4,013,921 for example, that the visibility of a warning light is enhanced if a lamp is caused to "flash" in rapid succession, the present circuit includes means for initiating firing of the flashtube at desired regular intervals, say once per second, and producing a double flash at that rate. In particular, firing of the flashtube is controlled by pulses generated by a third timer U1, for example a KS555 timer, which are modified by a circuit including a capacitor C8 connected to the OUTPUT terminal of the timer, a resistor R11, and a line 16 for applying the modified pulses to the gate electrode of TRIAC Q5. The timer U1, which operates independently of timer U2, produces a square wave output signal, depicted in FIG. 5, having a period T and high and low times $t_1$ and $t_2$, respectively. For a flash rate of sixty flashes per minute the period T would be one second, and for reasons soon to become apparent, $t_1$ and $t_2$ may be 0.8 sec. and 0.2 sec., respectively. The series combination of C8 and R11 forms a differentiator that produces sharp positive- and negative-going pulses on the rising and falling edges, respectively, of the timer output pulses. These pulses are routed over line 16 to the gate of TRIAC Q5, which fires in response to the application of both positive and negative signals. Firing of the TRIAC, first in response to the negative-going pulse of a pair, instantaneously discharges capacitor C7 through the primary of trigger transformer T2, producing a high voltage in its secondary which, because the voltage across capacitor C6 then exceeds the threshold firing voltage of flashtube 14, renders the flashtube conductive so as to produce a first flash. Meantime, with the termination of the negative-going pulse TRIAC Q5 has become non-conducting, allowing capacitor C7 to again be charged through resistor R9. The light pulse has a duration of approximately 300μsec after which the storage capacitor C6 begins charging for a 0.2 sec. period. During this time the voltage on capacitor C6 climbs above the threshold firing voltage of the flashtube, the positive-going pulse of the pair again fires the TRIAC, discharging capacitor C7 and producing a second voltage spike in the secondary of the trigger transformer, which causes the flashtube to produce a second flash and to again discharge the energy stored in the capacitor so as to make it ready for the next charging cycle. Thus, two pulses are produced per second, the second following the first by 0.2 sec. (in this example) to provide a much more eye-catching visual alarm than does a single flash occurring at the same rate.

Resistors R12 and R13 connected in series and in series with a capacitor C9 from line 10 to ground control the $t_1$ the $t_2$ parameters of the U1 timer output signal and ultimately the timing between the first and second flashes. A resistor R14 connected in series with capacitor C8 protects the output drivers of timer U1 from current surges injected into the gate of TRIAC Q5 upon discharge of capacitor C7.

The circuit includes over-voltage protection circuitry for protecting capacitor C6 from catastrophic failure in the event the flashtube cannot be triggered. The protection circuitry includes a voltage divider consisting of series-connected resistors R16 and R17 connected in parallel with capacitor C6 for producing and applying through a Zener diode Z2 a reference voltage for the emitter-to-base junction of a transistor Q6, the collector of which is connected to the TRIGGER/THRESHOLD terminal of the first timer embodied in timer U2. If the voltage across capacitor C6 exceeds a predetermined level, Zener diode Z2 conducts current and turns transistor Q6 "ON", pulling the TRIGGER/THRESHOLD terminal of the first timer to approximately one volt. This forces the OUTPUT O1 high, disabling the second timer and turning switch Q1 "OFF", and allows capacitor C6 to discharge until it stabilizes at the predetermined level.

When the TRIAC Q5 is switched into conduction its MT2 terminal is pulled toward ground, causing capacitor C7 to discharge and produce a high voltage spike at the secondary of transformer T2 thereby flashing the flashtube. To prevent afterglow of the flashtube, the action of the TRIAC is also coupled through a diode D4 to a capacitor C5 whose other terminal is connected to ground. The junction formed by capacitor C5 and diode D4 is coupled to the TRIGGER/THRESHOLD terminal of the first timer via a diode D5. When the voltage on C5 is pulled low by the MT2 terminal of the TRIAC being pulled toward ground (approximately one volt) the U2 oscillator is disabled and the output O2 is driven to zero state causing switch Q1 to switch "OFF". The oscillator will remain disabled for a predetermined amount of time, determined by the values of resistors R3, R4 and capacitor C5, sufficient to ensure that the flash from the flashtube is completely extinguished before recharging of capacitor C6 resumes.

By way of example, the following parameters may be used for the elements of the FIG. 1 circuit to obtain a double flash frequency of 60 FPM:

| ELEMENT | Value or No. |
|---|---|
| D1 | 1N5404 |
| D2, D3 | HER 106 |
| D4 | HER 106 |
| D5 | 1N4148 |
| Z1 | 1N5237B |
| Z2 | 1N4747A |
| R1 | 59K |
| R2 | 10 ohms |
| R3 | 56.2K |
| R4 | 1K |
| R5 | 10K |
| R6 | 1M |
| R7 | 22.1K |
| R8 | 10K |
| R9 | 470K |
| R10 | 1M |
| R11 | 100K |
| R12 | 274K |
| R13 | 178K |
| R14 | 150K |
| R16 | 470K |
| R17 | 22K |
| R18 | 10K |
| R19 | 22K |
| R20 | 1M |
| C1 | 100 μf |
| C2, C3 | .001 μf |
| C4 | 4.7 μf |
| C5, C8 | .1 μf |
| C6 | 82 μf |
| C7 | .047 μf |
| C9 | 2.2 μf |
| Q1, Q4 | 2N2907 |
| Q2 | 2N6515 |
| Q3 | 2N4401 |
| Q5 | L401ES |
| Q6 | 2N4401 |
| T1 | WHEELOCK |
| T2 | ZS1052 |
| 14 | BUB0661 |

Figure 6:
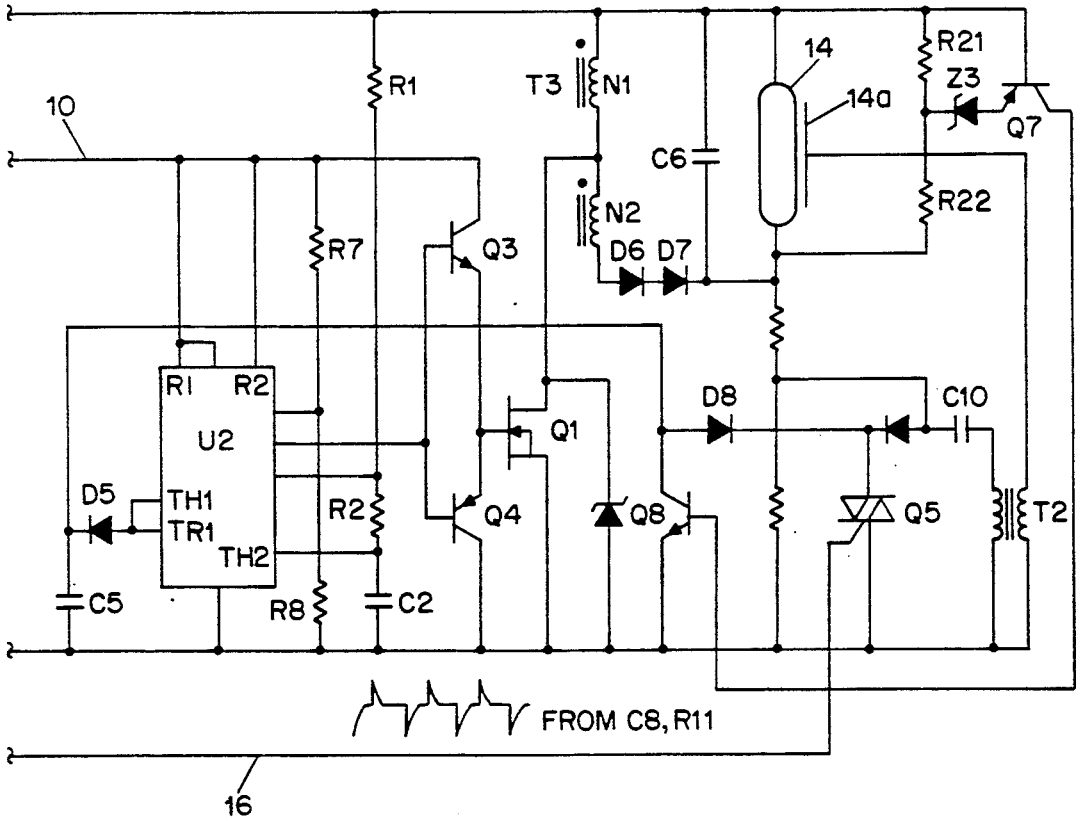
FIG. 6 is a circuit diagram showing a second embodiment of the strobe circuit.

A second embodiment of the invention, partially shown in FIG. 6, differs from the FIG. 1 embodiment primarily in that the isolating transformer T1 is replaced with an autotransformer T3 and the over-voltage protection and afterglow prevention circuitry differ in details. The primary winding N1 of autotransformer T3 is connected in series with switch Q1 across the D.C. voltage source and, as in the first embodiment, switch Q1 is repetitively opened and closed and timed by the cooperation of the voltage developed across capacitor C2 and timer U2. When switch Q1 is closed current builds up in the primary winding N1 as shown in FIG. 3; it remains closed until the voltage across capacitor C2 reaches the threshold voltage of the second timer in U2, at which time the timer turns Q1 "OFF". When Q1 is turned "OFF", capacitor C2 discharges and the energy stored in the primary N1 is transferred via the secondary winding N2, with a step-up in voltage, and a pair of series-connected diodes D6 and D7 to the storage capacitor C6 connected in parallel with flashtube 14.

As in the FIG. 1 circuit, the amount of energy transferred to capacitor C6 upon each opening of switch Q1 is maintained constant by initiating the charging cycles at regular intervals by closing switch Q1 in response to square wave pulses generated by the first timer of U2 of a frequency sufficiently high to supply increments of energy to the storage capacitor at a rate such that during the flash period the capacitor will attain a voltage sufficient to permit the flashtube to be fired twice each period.

Firing of the flashtube 14 is controlled by sharp positive- and negative-going pulses coupled from the differentiator C8R11 (FIG. 1) over line 16 to the gate of TRIAC Q5, which fires in response to both positive and negative pulses. Upon each firing of the TRIAC, capacitor C10 is rapidly discharged through the primary of trigger transformer T2 to produce a voltage in its secondary which is applied to the trigger band 14*a* of the flashtube. The voltage across capacitor C6 exceeds the threshold firing voltage of the flashtube each time a trigger pulse is applied to the TRIAC.

The storage capacitor is protected against damage in the event the flashtube cannot be triggered by protection circuitry which includes a voltage divider consisting of series-connected resistors R21 and R22 connected in parallel with capacitor C6 which produces and applies through a Zener diode Z3 a reference voltage for the emitter-to-base junction of a transistor Q7, the collector of which is connected via a transistor Q8 to the TRIGGER/THRESHOLD terminal of the first timer embodied in timer U2. If the voltage across capacitor C6 exceeds a predetermined level, diode Z3 conducts current and turns transistor Q7 "ON" which, in turn, switches transistor Q8 "ON", pulling the TRIGGER/THRESHOLD terminal of the first timer of U2 to ground. This forces the output 01 high, disabling the second timer and turning switch Q1 "OFF", and interrupting the charging process long enough for capacitor C6 to discharge until it stabilizes at the predetermined level.

Afterglow of the flashtube is prevented by coupling the MT2 terminal of TRIAC Q5 through a diode D8 to the TRIGGER/THRESHOLD terminal of the first timer of U2. When the TRIGGER/THRESHOLD terminal is pulled low by the MT2 terminal of the TRIAC being pulled toward ground, the second timer is disabled causing switch Q1 to be turned "OFF" for a period sufficient to ensure that the flash is extinguished before recharging of capacitor C6 resumes; this period is determined by the values of capacitor C5 and resistors R3 and R4.

The elements of the FIG. 6 embodiment not found in the foregoing chart may have the following values:

| Element | Value or No. |
|---|---|
| D6, D7, D8 | HER 106 |
| Z3 | 1N4747A |
| R20 | 22K |
| R21 | 470K |
| C10 | .047 μf |
| Q7 | 2N6520 |
| Q8 | 2N4401 |

By way of summary, because in the present circuit the flashtube and its parallel storage capacitor are placed across the secondary of the transformer, instead of across the switch, capacitor currents cannot flow in the power lines. The described energy conversion technique allows operation of the circuit over a wide range of input voltages while maintaining a constant flash rate, light intensity per flash, and power draw from the power supply. Because the flashtube is triggered into conduction, instead of being fired upon attainment of a voltage across the storage capacitor corresponding to the threshold firing voltage of the flashtube, the flash time is independent of the voltage level across storage capacitor C6 with the consequence that neither the flash time nor the brilliance of the flash is affected by variations in the capacitance of the storage capacitor. The circuit is very efficient due to the use of a capacitor for monitoring the current flowing through the transformer primary and the transistor switching measures employed.

While preferred embodiments have been shown and described, various modifications and substitutions may be made thereto without departing from the spirit and scope of the invention. Accordingly, it is to be understood that the foregoing description of the present invention is by way of illustration and not limitation.

I claim:

1. A strobe light circuit for flashing a flashtube at a desired frequency, comprising:

a D.C. power source for providing power at a voltage subject to variation over a range of voltages;

a transformer having a primary winding for storing energy and a secondary winding inductively coupled thereto;

first switch means for connecting and disconnecting said primary winding across said source to cause energy to be stored in said primary winding during periods of connection and to cause said stored energy to be coupled to said secondary winding during periods of disconnection;

a flash unit which includes said flashtube and is operable responsively to trigger pulses applied thereto to fire said flashtube;

a first capacitor connected in parallel with said flash unit for storing energy and discharging its stored energy through the flashtube upon triggering of said flash unit;

means for connecting said parallel combination of said flash unit and said first capacitor effectively across the secondary winding of said transformer when said primary winding is disconnected from said power source by said first switch means;

circuit means for monitoring current flow in said primary winding including a capacitor connected across said source and in parallel with said series-connected primary winding and first switch means; and means for repetitively cycling said first switch means between its open and closed states, said cycling means including means for generating a first timing signal and being operative in response to the attainment of a predetermined voltage across said second capacitor to initiate the open period of said first switch means and being operative in response to said first timing signal to initiate the closed period of said first switch means.

2. A strobe light circuit as defined in claim 1, wherein said circuit means for monitoring current flow further includes a resistor connected in series with said second capacitor across said power source; and wherein said cycling means includes said means for generating said first timing signal for initiating the closed period of said switch cycle at regular intervals and wherein attainment of a predetermined voltage across said second capacitor causes sufficient energy to be stored in said primary winding during each cycle, regardless of variations in source voltage within said range, that the energy transferred to said first capacitor during the open state of all of the switch cycles occurring during one flash period at said desired frequency will be sufficient to produce a charge across said first capacitor sufficient to cause said flashtube to flash.

3. A strobe light circuit as defined in claim 2, wherein said means for generating said first timing signal comprises an oscillator for producing an output pulse for each cycle period, and wherein said circuit further comprises means for protecting said first capacitor from failure in the event said flashtube cannot be triggered, said means for protecting including means in circuit with said first capacitor and said means for generating said first timing signal for disabling said means for generating said first timing signal and interrupting cycling of said first switch means in response to the charge on said first capacitor exceeding a predetermined voltage.

4. A strobe light circuit as defined in claim 1, wherein said flash unit includes second switching means for triggering said flashtube twice in close succession during each cycle period.

5. A strobe light circuit as defined in claim 4, wherein said second switching means is adapted to trigger said flashtube in response to application thereto of both positive and negative pulses, and wherein said circuit further comprises:

means for generating a second timing signal, independently of the generation said first timing signal, said second timing signal being a square wave signal having a period T which is the reciprocal of said desired flash frequency, a high time of $t_1$ and a low time of $t_2$;

means for differentiating said second timing signal to obtain positive- and negative-going pulses; and means for applying said positive- and negative-going pulses to said second switching means for causing said flashtube to produce two flashes at said desired flash frequency, a second of which follows a first by a predetermined time period.

6. A strobe light circuit as defined in claim 5, wherein said second switching means comprises a third capacitor and a TRIAC having a gate electrode, said TRIAC being operative in response to application to said gate electrode of either a positive- or a negative-going pulse to discharge said third capacitor and trigger said flashtube on each applied pulse, and wherein said circuit further comprises means in circuit with said TRIAC and said means for generating said first timing signal and operative in response to each discharge of said third capacitor to disable said means for generating said first timing signal and interrupt cycling of said first switching means for a time sufficient to ensure that recharging of said first capacitor is not resumed until the flashtube is completely extinguished after each flash.

7. A strobe light circuit for flashing a flashtube at a desired frequency, comprising:

a D.C. power source for providing power at a voltage which is subject to variation over a range of voltages;

a transformer having a primary winding for storing energy and a secondary winding inductively coupled to the primary winding;

first switch means connected in series with said primary winding for connecting and disconnecting said primary winding across said source to store energy in said primary winding during the periods of connection;

circuit means for monitoring current flow in said primary winding including a resistor and a first capacitor connected in series across said power source and in parallel with said series-connected primary winding and said first switch means;

a flash unit which includes said flashtube and a trigger circuit operable responsively to the application of trigger pulses to fire said flashtube when the voltage across the flashtube at the time the trigger pulse is applied exceeds its threshold firing voltage;

means including a first timing signal generator for generating and applying trigger pulses to said trigger circuit, at said desired frequency, for causing said flashtube to produce at least one flash in each flash period;

a second capacitor connected in parallel with said secondary winding and with said flash unit for storing energy during periods of disconnection of said primary winding and for discharging the stored energy through the flashtube upon each triggering of said flash unit;

means including a diode for connecting said parallel combination of said flash unit and said second capacitor effectively across the secondary of said transformer when said primary is disconnected from said power source, said diode being poled to prevent current flow from said second capacitor to said secondary winding; and means for repetitively cycling said first switch means between its open and closed state comprising a second timing signal generator for providing an output pulse for each cycle for initiating, at regular intervals, the closed period of said first switch means and operative to initiate the open period of each switch cycle in response to the attainment of a voltage across said first capacitor of a value such as to cause sufficient energy to be stored in said primary winding during each cycle that the energy transferred to said second capacitor during the open periods of all of the switch cycles occurring during one flash period is sufficient to produce a charge across said second capacitor sufficient to fire said flashtube each time a trigger pulse is applied to said trigger circuit.

8. A strobe light circuit as defined in claim 7, wherein said circuit further comprises:

means in circuit with said second capacitor and said second timing signal generator responsive to the charge on said second capacitor exceeding a predetermined voltage for disabling said second timing signal generator and interrupting cycling of said first switch means, for protecting said second capacitor from failure in the event said flashtube cannot be triggered.

9. A strobe light circuit as defined in claim 7, wherein said trigger circuit includes a third capacitor and a TRIAC connected in circuit with said third capacitor for discharging said third capacitor responsively to each applied trigger pulse, and wherein said circuit further comprises means in circuit with said TRIAC and said second timing signal generator operative in response to each discharge of said third capacitor to disable said second timing signal generator and interrupt cycling of said first switch means for a time sufficient to ensure that recharging of said second capacitor is not resumed until after each flash from said flashtube is extinguished.

10. A strobe light circuit as defined in claim 1, wherein said transformer is an isolating transformer.

11. A strobe light circuit as defined in claim 1, wherein said transformer is an autotransformer.

12. A strobe light circuit as defined in claim 7, wherein said transformer is an isolating transformer.

13. A strobe light circuit as defined in claim 7, wherein said transformer is an autotransformer.

* * * * *